US009920458B2

(12) United States Patent
Damour, Jr.

(10) Patent No.: US 9,920,458 B2
(45) Date of Patent: Mar. 20, 2018

(54) PROCESS FOR MANUFACTURING FLAME-RETARDANT YARNS

(71) Applicant: MERMET, Veyrins-Thuellin (FR)

(72) Inventor: François-Xavier Damour, Jr., Lyons (FR)

(73) Assignee: MERMET, Veyrins-Thuellin (FR)

( * ) Notice: Subject to any disclaimer, the term of this patent is extended or adjusted under 35 U.S.C. 154(b) by 0 days.

(21) Appl. No.: 15/305,668

(22) PCT Filed: Apr. 21, 2015

(86) PCT No.: PCT/FR2015/051075
§ 371 (c)(1),
(2) Date: Oct. 21, 2016

(87) PCT Pub. No.: WO2015/162371
PCT Pub. Date: Oct. 29, 2015

(65) Prior Publication Data

US 2017/0044694 A1 Feb. 16, 2017

(30) Foreign Application Priority Data

Apr. 22, 2014 (FR) ..... 14 53617

(51) Int. Cl.
*D02G 3/40* (2006.01)
*D01F 8/04* (2006.01)
(Continued)

(52) U.S. Cl.
CPC ..... *D02G 3/404* (2013.01); *D01D 11/06* (2013.01); *D01F 1/07* (2013.01); *D01F 8/04* (2013.01); *D02G 3/443* (2013.01)

(58) Field of Classification Search
CPC ..... D02G 3/404; D02D 11/06; D01F 1/07
See application file for complete search history.

(56) References Cited

U.S. PATENT DOCUMENTS 6,150,448 A 11/2000 Nozaki et al.
2012/0074612 A1* 3/2012 Scrivens ..... D04H 1/413 264/164
(Continued)

FOREIGN PATENT DOCUMENTS

EP 0 900 294 B1 3/1999
EP 2 562 208 A1 2/2013
(Continued)

OTHER PUBLICATIONS

French Search Report dated Feb. 19, 2015 for Application No. FR 1453617.
(Continued)

*Primary Examiner* — Dah-Wei D Yuan
*Assistant Examiner* — Kristen A Dagenais
(74) *Attorney, Agent, or Firm* — Ladas & Parry LLP

(57) ABSTRACT

The present invention relates to a method of fabricating a yarn constituted by a multi-filament core coated in a polymer sheath. The sheath is made by depositing a miscible mixture of molten polymers on the multi-filament core, the mixture comprising:

at least one flame-retarding agent; and at least two polymers that, in the molten state, do not establish mutual permanent chemical bonds, with one of the polymers, referred to as the co-flame-retarding polymer, presenting both a glass transition temperature that is significantly lower than the glass transition temperature of the other polymer, referred to as the base polymer, and also a melting temperature that is likewise significantly lower than the melting temperature of the base polymer;

said deposition being followed by a cooling step during which the base polymer freezes first and the co-flame-
(Continued)

retarding polymer migrates outwards entraining at least a fraction of the flame-retarding agent therewith.

23 Claims, 1 Drawing Sheet

(51) Int. Cl.

| | |
|---|---|
| ***D01F 1/07*** | (2006.01) |
| ***D01D 11/06*** | (2006.01) |
| ***D02G 3/44*** | (2006.01) |

(56) References Cited

U.S. PATENT DOCUMENTS

| | | | | |
|---|---|---|---|---|
| 2014/0138584 | A1* | 5/2014 | Bond | C11D 13/10 252/367.1 |
| 2014/0145374 | A1* | 5/2014 | Altonen | C08K 5/11 264/328.14 |

FOREIGN PATENT DOCUMENTS

| | | | | | |
|---|---|---|---|---|---|
| JP | 2000-119961 | A | | 4/2000 | |
| JP | 2011-202397 | A | | 10/2011 | |
| JP | 2011202397 | A | * | 10/2011 | |
| WO | 99/65661 | A1 | | 12/1999 | |
| WO | WO 9965661 | A1 | * | 12/1999 | B29B 15/122 |
| WO | 03/056082 | A2 | | 7/2003 | |
| WO | WO 03056082 | A2 | * | 7/2003 | D02G 3/404 |

OTHER PUBLICATIONS

International Search Report dated Jul. 17, 2015 for Application No. PCT/FR2015/051075.

Espacenet English abstract of JP 2011-202397 A.

Patent Abstracts of Japan English abstract of JP 2000-119961 A.

Espacenet English abstract of WO 97/42363 which corresponds to EP 0 900 294 B1.

* cited by examiner

PROCESS FOR MANUFACTURING FLAME-RETARDANT YARNS

The present invention relates to the technical field of yarns adapted to making textile surfaces for providing protection against the sun. More precisely, the present invention relates to a novel method of fabricating flame-retardant yarns, said yarns preferably being halogen-free.

In the field of fabricating textiles for protection against the sun, it is desired to have yarns that are flame-retardant. It is necessary to treat the yarn with a flame-retarding agent. For this purpose, core yarns are generally coated in a flame-retardant polymer composition. Proposals are made in particular to sheathe a core yarn using a PVC plastisol, which may be subjected to restrictions on its use because of the presence of chlorine. Such a technique is described in particular in Documents EP 2 562 208 and EP 0 900 294, where proposals are made to obtain a composite yarn by sheathing a fiberglass core yarn with a PVC plastisol that is flame-proofed by a ternary mixture comprising a zinc borate, an oxygenated antimony compound, and a hydrated oxide of a metal selected from the group constituted by aluminum, magnesium, tin, zinc, and lead.

Other solutions propose obtaining satisfactory flame-retarding properties for halogen-free yarns that are desired for environmental reasons, by making use of large quantities of flame-retarding fillers, which is incompatible with obtaining yarns that are fine (corresponding to a mean count of the order of 80 tex to 120 tex). Furthermore, when using flame-retarding fillers in large quantity, some of those fillers are to be found close to the filaments, where they act as abrasives, thereby weakening the final yarn that is obtained. As a result, halogenated polymers requiring a smaller quantity of flame-retarding agent are preferred. Another solution consists in using halogenated flame-retarding agents, e.g. such as deca bromo diphenyl ether or deca bromo diphenyl ethane or chlorinated paraffins, which are particularly effective and can thus be used at lower concentrations, on their own or in synergy with salts of antimony, such as antimony trioxide. This applies for example to the sheathed yarn fabrics sold by the supplier Mechoshade, in which the yarn and the sheath are formed by a thermoplastic olefin: the fabric having reference 1350 produced by Mechoshade is made with yarns having a diameter of about 500 micrometers (μm). This result is obtained by depositing a sheath having a thickness of about 100 μm on a core yarn having a mean diameter of about 300 μm. The fabrics obtained in this way possess excellent flame-retardant properties, and at certain compactnesses they can achieve classifications of the M1 type as specified by the French standard NPF92.507. The quantity of bromine present in those fabrics is about 4.5%. Furthermore, it should be emphasized that most of bromine-containing flame-retarding agents are suspected of being toxic and that deca bromo diphenyl ether, which at present continues to be one of the bromine-containing flame-retarding agents with the best performance, is included in the list of substances of very high concern (SVHC) as specified in the European regulations concerning registration, evaluation, authorization, and restriction of chemicals (REACH).

Thus, at present, there does not exist any known technical solution making it possible to make composite yarns of small diameter (mean diameter of about 200 μm to 400 μm) obtained by extruding a sheath onto a core yarn and suitable for making highly flame-retardant textile surfaces. The term "highly flame-retardant" is used to mean textile surfaces having M1 classification in accordance with French standard NFP 92.507, or B1 classification in accordance with German standard DIN 4102.

In this context, one of the objects of the present invention is to provide a novel method of fabricating small-diameter flame-retardant yarns capable of being used for making highly flame-retardant textile surfaces compatible with applications in the field of providing protection against the sun. In particular, in a preferred implementation, the method of the invention makes it possible to avoid making use of halogen-containing ingredients, which are recognized as being noxious.

More precisely, the present invention provides a method of fabricating a yarn constituted by a multi-filament core coated in a polymer sheath, said sheath comprising two coaxial polymer zones in succession, referred to as an inner zone and an outer zone, the outer zone incorporating at least one flame-retarding agent, the concentration of the flame-retarding agent in the outer zone being greater than the concentration of the flame-retarding agent in the inner zone, the method being characterized in that the sheath is made by depositing a miscible mixture of molten polymers on the multi-filament core, the mixture comprising:

said at least one flame-retarding agent; and at least two polymers that, in the molten state, do not establish mutual permanent chemical bonds, with one of the polymers, referred to as the co-flame-retarding polymer, presenting both a glass transition temperature that is significantly lower than the glass transition temperature of the other polymer, referred to as the base polymer, and also a melting temperature that is likewise significantly lower than the melting temperature of the base polymer;

said deposition being followed by a cooling step during which the base polymer freezes first and the co-flame-retarding polymer migrates outwards entraining at least a fraction of the flame-retarding agent therewith.

The method of the invention makes it possible in particular to produce halogen-free yarns. To do that, the materials constituting the multi-filament core, the polymer sheath, and the flame-retarding agent(s) that are present should be selected to be halogen-free. The yarns produced by the method of the invention are constituted by a multi-filament core, said multi-filament core being coated in a polymer sheath. According to an essential characteristic of the invention, said sheath has two coaxial polymer zones in succession, referred to as an inner zone and an outer zone, the outer zone incorporating at least one flame-retarding agent, the concentration of flame-retarding agent in the outer zone being greater than the concentration of flame-retarding agent in the inner zone. In preferred manner, the multi-filament core of an organic nature.

By using a particular mixture of polymers that are miscible when in the molten state, the method of the invention makes it possible to end up obtaining a multi-filament core that is protected by the inner zone of the resulting sheath, which inner zone is filled little or not at all with flame-retarding agent. The concentration of flame-retarding agent in the outer zone of the sheath serves to concentrate its action on the peripheral zone of the yarn, thereby leading to obtaining excellent fireproofing properties.

The quantities of polymers used are usually selected in such a manner as to obtain a yarn in which the sheath constitutes 40% to 80% by weight and preferably 50% to 70% by weight of the total weight of the yarn.

In order to obtain good flame-retarding properties, the quantities of flame-retarding agent(s) incorporated should be selected in such a manner as to obtain a yarn in which the outer zone contains a quantity of flame-retarding agent that corresponds to 15 percent by weight (wt %) to 50 wt %, preferably 20 wt % to 30 wt %, relative to the total weight of the sheath. This weight percentage corresponds to the weight of flame-retarding agent over the total weight of the sheath multiplied by 100.

Advantageously, the yarns obtained with the method of the invention present a mean diameter lying in the range 150 μm to 500 μm, preferably in the range 200 μm to 400 μm. The mean diameter is the arithmetic mean of all of the diameter measurements taken, e.g. ten such measurements, in particular using MSD 25 type apparatus sold by the supplier Zumbach.

The method of the invention has the advantage of being simpler and less cumbersome to put into application than fabrication methods making use of two deposition operations comprising:

a first deposition step of depositing a first composition on the multi-filament core, in which the first composition is deposited so as to form a first polymer layer that constitutes the inner zone of the sheath; and a second deposition step of depositing a second composition onto the resulting first polymer layer, in which the second composition is deposited so as to form the outer zone of the sheath, the second composition incorporating at least one flame-retarding agent.

The method of the invention having only one deposition step also makes it possible to have continuity in the polymer layer with a common material that is present throughout its volume. There is therefore a reduction in the number of interfaces in the material, and thus an increase in its cohesion.

The following detailed description given with reference to the accompanying figures enables the invention to be better understood.

In the context of the invention, the sheath serves in conventional manner to protect the multi-filament core and to give cohesion to the filaments, thereby making the yarn usable on industrial transformation machines.

In the context of the invention, the sheath made around the multi-filament core also performs two roles: i) obtaining a sheathed yarn of circular section and of constant diameter; and ii) giving the yarn its flame-retardant nature. Thus, the yarn made by the method of the invention is circular in section, presenting a diameter over the entire length of the yarn that is constant to within plus or minus 10%. I.e. each measured value for the diameter belongs to the range: mean value plus or minus 10%. The mean value is the arithmetic mean of all of the diameter measurements taken, in particular using an MSD25 type appliance sold by the supplier Zumbach. In preferred manner, the multi-filament core surrounded by the inner zone presents a mean diameter lying in the range 100 μm to 400 μm to within plus or minus 10%, and preferably in the range 125 μm to 300 μm to within plus or minus 10%, so as to obtain, in association with the outer zone, a yarn having a total mean diameter of 150 μm to 500 μm to within plus or minus 10%, and preferably in the range 200 μm to 400 μm to within plus or minus 10%.

The high concentration of the flame-retarding agent at the periphery of the yarn is compatible with yarns of small diameter and good flame-proofing properties. Furthermore, the inner zone of the sheath protects the multi-filament core from attacks that it might suffer as a result of the presence of the flame-retarding agent, given that in the context of the invention, this agent is mainly located in the outer zone of the sheath.

Figure 1:
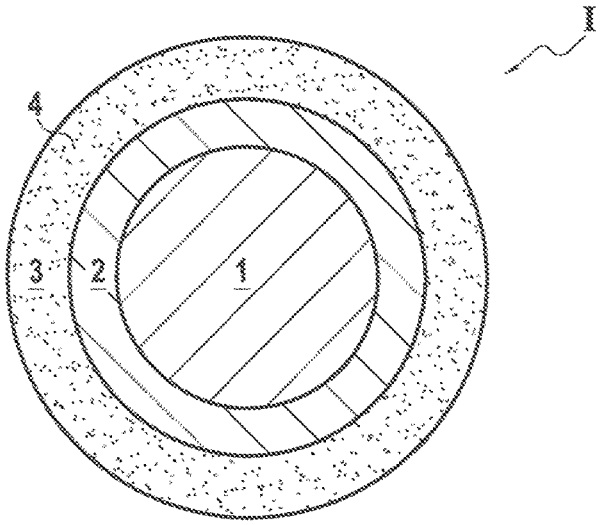
FIG. 1 is a diagrammatic view in cross-section of a yarn obtained by a method in accordance with the invention.

As can be seen in FIG. 1, the yarn I made using the method of the invention comprises a multi-filament core 1 surrounded by a sheath made up of two coaxial zones: an inner polymer layer or zone 2 and an outer polymer layer or zone 3 in which the flame-retarding agent 4 is distributed.

Each of the two zones of the sheath (inner zone and outer zone) is preferably uniform in size and composition. In particular, the flame-retarding agent is regularly distributed within the polymer matrix forming the outer zone.

In general, the inner polymer zone is in the minority in the composition of the sheath. It preferably represents 6% to 26% of the total weight of the composite yarn (i.e. core+sheath) and the quantities of base polymer and of co-flame-retarding polymer and of flame-retarding agent in the deposited mixture are adjusted so as to obtain such a percentage.

The concentration of flame-retarding agent in the outer zone of the polymer sheath surrounding the core yarn constituted by a set of filaments is greater than the concentration of flame-retarding agent in the inner zone, as a result of the migration that takes place in the method of the invention. The inner zone of the sheath may optionally incorporate a flame-retarding agent, in particular as a function of the quantity of flame-retarding agent present in the deposited mixture.

According to a preferred characteristic, the yarn made by the method of the invention (both the core and the polymer sheath) is halogen-free, i.e. none of its ingredients (material constituting the multi-filament core, polymer(s) constituting the sheath, flame-retarding agent(s) used in the method includes any halogen atom.

The core of the yarn made in accordance with the invention, referred to as a multi-filament core, is in the form of a set of filaments extending in a preferred direction. Such multi-filament cores correspond to multi-filament yarns commonly available commercially. In the context of the invention, it is preferable to use a multi-filament core presenting a count lying in the range 20 tex to 150 tex, preferably in the range 30 tex to 60 tex, as a function of the material constituting the core. Naturally, it is preferable to use multi-filament cores made of material that burns poorly. Advantageously, the multi-filament core is made of a material that does not contain any halogen. In a manner that is preferred for reasons of recycleability, the multi-filament core is made of an organic material, in particular of a thermoplastic polymer, preferably a polymer selected from: polyamides; polyesters (such as polyethylene terephthalate (PET)); polyurethanes; polyolefins (such as polypropylenes); and vinyl polymers (such as vinyl acetate); and also other artificial polymers such as cellulose acetate; and mixtures thereof. However, the core could be made of an organic material, for example being constituted by a bundle of fiberglass filaments. Nevertheless, the invention is particularly suitable for flameproofing a core made of combustible material, in particular of polyester or polyolefin type.

In the context of the invention, in order to obtain the two-layer polymer sheath of the invention having one or more flame-retarding agents concentrated in the outer layer, as shown in FIG. 1, the multi-filament core is covered in a composition comprising a mixture of molten polymers and at least one flame-retarding agent that enables the yarn to be sheathed and that is formulated so as to obtain, during cooling, migration of the flame-retarding agent to the periphery of the yarn.

In preferred manner, the polymer(s) constituting the sheath include(s) no halogen, thereby excluding in particular the polyvinyl chloride (PVC) family used in prior techniques based on plastisol. The polymer(s) constituting the inner and outer zones may for example be selected from: acrylic or methacrylic acid esters; non-halogenated vinyl polymers; copolymers of ethylene and vinyl acetate; polyolefins; styrene copolymers; polyurethanes; polyamides; polyesters; copolyamides; copolyesters; oleamides; erucamides; silicones; and acetals.

The nature of the polymer(s) constituting each of the two zones of the sheath depends in particular on the method used for making the various zones.

In the context of the invention, a miscible mixture of molten polymers is deposited, said mixture comprising at least one flame-retarding agent and at least two polymers belonging to different chemical families, with one of the two polymers (referred to as the co-flame-retarding polymer) presenting a glass transition temperature that is significantly lower than the glass-transition temperature of the other polymer (referred to as the base polymer), and also presenting a melting temperature that is likewise significantly lower than the melting temperature of the base polymer. The term "significantly lower" preferably means at least 10° C. less, and preferably about 20° C. to 30° C. less. Preferably, the difference between the melting temperature of the co-flame-retarding polymer and the melting temperature of the base polymer lies in the range 15° C. to 50° C., and preferably in the range 30° C. to 50° C. When the measured melting temperature or glass transition temperature varies over a range of values, the difference is determined by taking the arithmetic mean of the measurements, e.g. on the basis of five measurements for each of the temperatures to be compared. Naturally, given that a mixture of these two molten polymers is deposited, the co-flame-retarding polymer presenting the lower melting temperature should be selected to avoid being degraded at the melting temperature of the base polymer.

The polymer mixture that is deposited is said to be a mixture of polymers in the molten state that is "miscible", i.e. the mixture is uniform, and does not present any demixing or separation of the various polymers. However, that does not necessarily mean that the base polymer and the co-flame-retarding polymer are miscible in a mixture of only those two molten polymers. It may be necessary to add another polymer that makes it possible to obtain a mixture that is miscible.

The chemical natures of these two polymers are also selected so as to make it possible, during cooling, for the flame-retarding agent to become positioned in the outer zone, i.e. at the surface of the resulting final yarn. In particular, they are selected in such a manner that no permanent chemical bonds are established between the two polymers in the molten state. The term "permanent chemical bonds" is used to mean bonds that persist when the polymers are subjected to Brownian motion and therefore block the ability of one of the polymers to move relative to the other. Such bonds are in particular covalent bonds or Van der Waals bonds. This does not exclude the possibility of ionic bonds becoming established temporarily between the polymers in the molten state. During the cooling of the polymer mixture that is to constitute the sheath, the polymer that possesses the higher melting temperature, referred to as the "base" polymer, freezes first. The other polymer, referred to as the "co-flame-retarding" polymer, although miscible in the molten mixture with the base polymer, then migrates outwards, because of the absence of permanent chemical bonds between the two polymers in the molten state, and entrains therewith a fraction of the flame-retarding agent. The co-flame-retarding polymer preferably behaves as an adhesion promoter, becoming fixed in the molten state to the surface of the flame-retarding agent. For this purpose, the flame-retarding agent, when in the form of a solid, advantageously presents a large specific surface area, ideally greater than 50 square meters per gram ($m^2/g$). In preferred manner, likewise when the flame-retarding agent is in solid form, the wetting angle formed by the polymer in the molten state on the flame-retarding agent is less than 90°.

In general, in the final sheath, the base polymer is in crystallized or partially crystallized form.

Ideally, the base polymer has a number molecular weight Mn lying in the range 10,000 grams per mol (g/mol) to 30,000 g/mol, whereas the co-flame-retarding polymer presents a number average molecular weight Mn lying in the range 300 g/mol to 1000 g/mol.

Consequently, in the method of the invention for fabricating a yarn in which there is only a single deposition operation, the base polymer forms the inner zone and the co-flame-retarding polymer mixed with the base polymer forms the polymer matrix of the outer zone of the sheath. It is naturally possible for each of the zones to be formed of a mixture of polymers, including at least one in each of the zones and possibly in all of them, satisfying the conditions set out in the context of the invention. In preferred manner, the base polymer(s) constituting the inner zone of the sheath is/are selected from: acrylic or methacrylic acid esters; non-halogenated vinyl polymers; polyurethanes; polyamides; thermoplastic polyolefins; thermoplastic olefin (TPO) elastomers; styrene copolymers of the styrene butadiene rubber (SBR) type or of the styrene ethylene butylene styrene (SEBS) type; polyesters; and silicones; and the polymer matrix of the outer zone of the sheath is formed by at least one base polymer identical to that present in the inner zone and by at least one co-flame-retarding polymer selected from: copolyamides; copolyesters; polyurethanes; polyolefins; oleamides; erucamides; and styrene-based copolymers.

It is possible that the inner zone of the sheath may end up containing some quantity of flame-retarding agent but at a concentration that is low, which concentration will always be less than the concentration of flame-retarding agent in the outer zone.

Even when the inner zone includes some quantity of flame-retarding agent, it can generally be considered that at least 60% of the total weight of flame-retarding agent present in the sheath and preferably at least 75%, is present in the outer zone.

The nature of the polymer(s) used for constituting the sheath should also be adapted as a function of the final application intended for the yarn. For example, polymers presenting a high takeup of moisture, such as polyamides, are preferably used when the yarn is for indoor applications, whereas polymers that are not hydrolizable, such as ethylene vinyl acetate (EVA) or styrenes and their copolymers, are preferred for outdoor applications.

The flame-retarding agent(s) used in the method of the invention is/are preferably halogen-free. In particular, it is possible to use one or more flame-retarding agent(s) selected from phosphorous- or nitrogen-containing flame-retarding agents, such as: ammonium polyphosphates; melamine isocyanurate; derivatives of pentaerythritol and of melamine; and ammonium molybdates, as a function of the nature(s) of the polymer(s) present in the outer zone of the sheath. The nature(s) of the flame-retarding agent(s) present may thus be organic or inorganic. In known manner, the agent(s) is/are selected as a function of the nature(s) of the polymer(s) for constituting the outer zone of the sheath. When the outer zone is made of a polyamide, it is preferred to use nitrogen-containing flame-retarding agents, such as melamine isocyanurate. Numerous flame-retardant polymer compositions are commercially available and may be used as a component of the deposited mixture. Such polyamide-based compositions are available in particular from Addiplast, Albis, or Ultraspolymers or Arkema, and such EVA-based compositions are available from Arkema, Alphagary, or Eurofind. It is also possible to prepare the deposition compositions by using co-flame-retarding polymer(s) and agent(s) that are sold separately and that are subsequently mixed together or compounded.

The flame-retarding agent(s) may be in the form of one or more liquid compounds and/or of one or more solid compounds that preferably present small grain size. The term "small grain size" is used to mean particles in which the largest size is less than 50 μm. The flame-retarding agent is chosen in such a manner as to be distributed regularly throughout the deposition formulation that contains it. In particular, if it comprises one or more liquid compounds, they are soluble or miscible in the mixture of molten polymers. If it comprises one or more solid compounds, their small grain size makes it possible to obtain a regular dispersion within the mixture of molten polymers.

The method of constituting yarns of the invention consists in making the sheath in a single deposition operation, while selecting a deposition formulation that enables the molecules or particles of the flame-retarding agent to migrate into the peripheral portion of the sheath. Such deposition is preferably performed together with a step of calibration by extruding a sheath on the core yarn and by calibrating the sheath by passing through a die. Nevertheless, it is possible to cover and calibrate the textile core using any appropriate method well known to the person skilled in the art that enables a mixture of molten polymers to be deposited.

While making the covering that also constitutes the sheath of the yarn, the method consists in placing the flame-retarding agents at the periphery of the composite yarn. To do this, the formulation used is in the form of a miscible mixture of molten polymers and comprises the following elements:

one or more base polymers for conferring mechanical properties and for guaranteeing the durability of the sheath;

one or more flame-retarding agents formed by one or more liquid compounds and/or one or more solid compounds, preferably presenting small grain size; and one or more co-flame-retarding polymers presenting a glass transition temperature and a melting temperature that are significantly lower respectively than the glass transition temperature and the melting temperature of the base polymer so as to entrain at least a fraction of the flame-retarding agent to the periphery of the sheath during cooling.

The flame-retarding agent is regularly distributed in the mixture of molten polymers. This uniform distribution may be obtained by a mixing operation, e.g. under mechanical stirring. The formulation comprising the mixture of polymers in the molten state and the selected flame-retarding agent(s) is applied to the multi-filament core yarn by any appropriate technique that serves both to cover and to sheathe the multi-filament core. In particular, it is possible to use a technique that leads to a sheath being obtained that is circular in section and of constant diameter, such as the extrusion-sheathing technique. It is possible to preheat the core prior to the deposition operation.

The operation of cooling the covering as obtained in this way enables the fillers or flame-retarding molecules to be positioned at the periphery of the sheath, i.e. in the outer zone of the yarn that is finally obtained. The co-flame-retarding polymer behaves as an adhesion promoter and, while in the molten state, it becomes fixed to the surfaces of the fillers or molecules constituting the flame-retarding system. While the sheath is cooling, the base polymer, which has the higher melting temperature, freezes first. The co-flame-retarding polymer, which does not present any permanent chemical bonds with the base polymer in the molten state, is therefore not retained by chemical bonds and migrates towards the outside, taking with it the flame-retarding fillers that it coats. When the temperature of the composite yarn becomes lower than the glass transition temperature of the base polymer or than the melting temperature of the co-flame-retarding polymer, the migration of the co-flame-retarding polymer can no longer continue and the structure becomes frozen. The resulting yarn is then as shown in FIG. 1. It is therefore important to have complete control over the rate of cooling of the yarn. Advantageously, the yarn is cooled with a plateau at a temperature lower than the glass transition temperature of the base polymer but higher than the glass transition temperature of the co-flame-retarding polymer. This plateau preferably begins soon after the beginning of cooling, and in particular within less than 20 seconds (s), preferably less than 10 s, and more preferably less than 5 s after the beginning of cooling and/or it should last for 1 s to 10 s. For this purpose, it is possible by way of example to make use of the following modes of operation:

using successive cooling devices, such as vessels containing water or other heat transfer fluids or controlled-atmosphere chambers: the first vessel serves to quench the extruded yarn and bring its temperature, within a few seconds (ideally <5 s), to a temperature lower than the glass transition temperature of the base polymer but higher than the glass transition temperature of the co-flame-retarding polymer. The second vessel serves to maintain this temperature for a few seconds (ideally >10 s). The co-flame-retarding polymer then migrates to the peripheral zone of the composite yarn. This solution should be used when the base polymer and the co-flame-retarding polymer possess melting and glass transition temperatures that are relatively close together (difference less than 20° C.); and using a single cooling device as defined above, enabling the composite yarn to be quenched so as to bring its temperature within a few seconds to a value lower than the glass transition temperature of the base polymer but well above the glass transition temperature of the co-flame-retarding polymer. By "well above" it is understood that the temperature is at least 20° C. greater than the glass transition temperature of the co-flame-retarding polymer. This solution is preferred when the base polymer and the co-flame-retarding polymer possess glass transition temperatures that differ by at least 20° C.

In the end, the outer zone is thus made up of at least three components: a base polymer; an co-flame-retarding polymer; and a flame-retarding agent.

As examples of polymers suitable for use as the base polymer, mention may be made of: acrylic or methacrylic acid esters; non-halogenated vinyl polymers; polyurethanes; polyamides; thermoplastic polyolefins; thermoplastic olefin (TPO) elastomers; styrene copolymers of the styrene butadiene rubber (SBR) type or of the styrene ethylene butylene styrene (SEBS) type; polyesters; and silicones.

As examples of polymers that can be used as the co-flame-retarding polymer, mention may be made of: copolyamides; copolyesters; polyurethanes; polyolefins; oleamides; and erucamides; and also styrene-based copolymers.

Naturally, the base polymer and co-flame-retarding polymer pair should be selected so as to satisfy the following conditions:

in the molten state, they must be capable of forming a mixture that is miscible, possibly in combination with another polymer. Specifically, if the base polymer and the co-flame-retarding polymer on their own are not miscible when in the molten state, it is possible to obtain a miscible mixture by adding some other polymer that is independently miscible with each of them. It is thus possible to cause mixtures of polyamide and of polyester in the molten state to become miscible by using copolyamide hot-melts as a compatibilizer agent for these two polymers. Likewise, it is possible to envisage using silane-containing polymers to make mixtures of polyamides and polyurethanes compatible;

they must not present permanent chemical bonds in the molten state; and the co-flame-retarding polymer must have a glass transition temperature that is significantly lower than the glass transition temperature of the base polymer, and also a melting temperature that is significantly lower than the melting temperature of the base polymer.

As examples of polymer materials suitable for use in the method of the invention, mention may be made of the following mixtures:

EXAMPLE 1 base polymer: polyamide 6 (60 parts by weight (pbw));
co-flame-retarding polymer: copolyester (30 pbw); and
compatibilizer: copolyamide (10 pbw).

EXAMPLE 2 base polymer: polyolefin (60 pbw);
co-flame-retarding polymer: styrene butadiene styrene copolymer (20 pbw); and
compatibilizer: ethylene acrylic acid maleic anhydride terpolymer (20 pbw).

The cooling step may be performed by passing the yarn through a cooling zone, in particular a zone maintained at a temperature lying in the range 3° C. to 25° C. It is possible to use the conventional cooling techniques as used in any coating, extrusion, and/or hot-melt deposition methods, and indeed as also used after each of two deposition operations in a two-stage method.

In preferred manner, the outer zone is not obtained by depositing a polymer dispersion in plastisol form or in the form of an aqueous dispersion. The plastisol technique is not used since it requires the use of plasticizer(s), i.e. compounds of small molecular weight, that migrate and sweat out through the surface of the yarns, leading to a greasy feel. Advantageously, the aqueous dispersion technique is not used either, since it does not enable a continuous sheath to be obtained in the outer zone where such continuity serves to guarantee that the core yarn is protected against aggression from the outside medium. Advantageously, the method of the invention does not use a plastisol nor does it use a plasticizer, such that the sheath does not contain a plastisol or a plasticizer.

The various steps of the method of the invention may be performed continuously so as to lead to very great lengths of yarn. The yarns obtained at the end of the method of the invention may be wound onto reels prior to being used.

In the context of the invention, the proposed composite yarn may have no halogen and may be obtained by sheathing a multi-filament core yarn with a coating that comprises at least two successive zones of different compositions:

an inner zone positioned on the core yarn and leading to a yarn being obtained that is circular in section and constant in diameter; and an outer zone constituted by a flame-retardant covering that is uniform in composition and in thickness and that is deposited on the inner zone.

Since the yarns proposed in the context of the invention are for making textile surfaces for providing protection against the sun, the various components used for making the yarns of the invention should be selected so as to possess all of the technical characteristics of materials used for this purpose, and in particular resistance against ultraviolet (UV) radiation as measured by Xenotest artificial aging tests in compliance with the standard NF EN ISO 105B02, resistance to dirtying and suitability for cleaning, mechanical properties needed for making awning textiles, and the ability to withstand bad weather, high temperatures, and low temperatures, in particular when the yarn is for outdoor applications.

The method of the invention may lead to yarns presenting a high level of flameproofing of the type known as M1 in the standard NFP92507 or B1 in the standard DIN 4102.

The sheathed flame-retardant yarns obtained by the method of the invention may be used for making textiles or used in providing protection against the sun, which textiles may be woven fabrics, woven or non-woven scrim, and knits constituted at least in part, or indeed completely, of yarns in accordance with the invention.

The flame-retardant yarn obtained by the method of the invention may be used for making textiles adapted to providing protection against the sun, in particular for fabricating awnings. For this purpose, the yarn obtained by the method of the invention should be woven, interlocked, knitted, or adhesively-bonded depending on the selected architecture, by any appropriate technique well known to the person skilled in the art. Fabrics, scrim, or knits, made by using yarns obtained by the method of the invention and presenting a low opening factor, in particular of about 0 to 15%, and preferably in the range 3% to 10%, present the properties that are required, in particular in terms of protection against the sun and resistance to fire. Such textiles may be for placing indoors or outdoors. The yarns of the invention make it possible to make textiles presenting flameproofing performance that complies with a classification of type M1 in accordance with French standard NFP92507 and of type B1 in accordance with German standard DIN 4102.

The examples below serve to illustrate the invention, but they have no limiting character.

EXAMPLE 1—METHOD WITH A SINGLE DEPOSITION STEP

An example of composite yarn of the invention is described below:

multi-filament core: 2×167 dtex S120 PET yarn (mean diameter: 210 μm) not treated against fire (commercial reference: Trevira 691 G from Trevira);

base polymer and flame-retarding fillers: type V0 flame-retardant polyamide 6 (commercial reference: Vampamid PA6 0024 V0 from Vamp Tech)—constituting 60% by weight of the sheath (melting temperature: 245° C. to 265° C., glass transition temperature (Tg): 50° C. to 60° C.);

co-flame-retarding polymer: copolyester (commercial reference: Griltex 2132 E from EMS division Griltex), representing 20% by weight of the sheath (melting temperature: 110° C. to 120° C., Tg: 18° C. to 20° C.); and polymer used for obtaining a miscible mixture: copolyamide oligomer (commercial reference: Griltex D 1549 A from EMS division Griltex), constituting 20% by weight of the sheath (melting temperature: 115° C. to 145° C., Tg: 18° C. to 30° C.)

Figure 2:
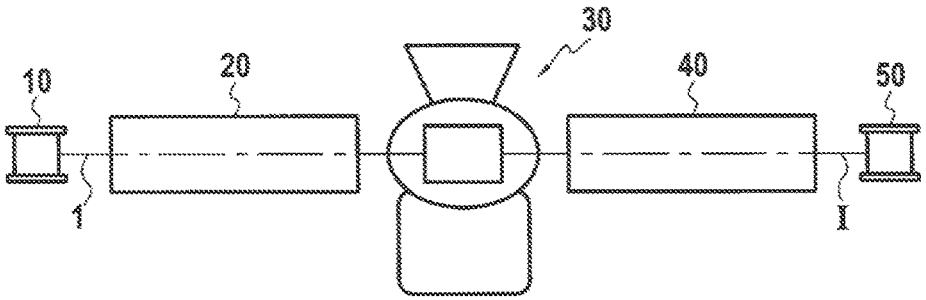
FIG. 2 is a diagrammatic view of an example of an installation for performing a method of the invention with a single deposition operation.

The fabrication method used is shown diagrammatically in FIG. 2: the yarn 1 constituting the multi-filament core is unreeled from a reel 10 to pass through a preheating zone 20 prior to reaching an extrusion sheathing device 30 that terminates in a die, from which it proceeds to a cooling zone 40 in order to obtain a yarn I of the invention suitable for being stored after being wound onto a reel 50.

Operating Conditions:

preheating of the yarn: 90° C.;

extrusion temperatures:

| Feed zone | Body of the extrusion device | Die |
|---|---|---|
| 180° C. | 200° C. to 220° C. | 245° C. |

material pressure: 5 bars;

cooling temperature: 30° C.;

winding tension: 150 grams per yarn (g/yarn);

winding speed: 400 meters per minute (m/min);

mean diameter of the yarn finally obtained: 350 μm.

Textile surfaces made using this yarn by knitting or weaving (18/18 basket weave) led to products having M1 classification under the standard NFP 92507 and B1 classification under the standard DIN 4102/1.

EXAMPLE 2—METHOD WITH A SINGLE DEPOSITION STEP

Another example of a composite yarn of the invention is described below:

multi-filament core: 300 dtex S120 polypropylene (PP) yarn (mean diameter: 210 μm) with flameproofing treatment (commercial reference PP Yarn 300 Tangle from Ponsa);

base polymer and flame-retarding fillers: V0 type flame-retardant ethylene vinyl acetate (EVA) copolymer (commercial reference: Megolon HF1876 from Alphagary)—constituting 60% by weight of the sheath (melting temperature: 165° C. to 175° C., Tg: 80° C. to 90° C.);

SEBS co-flame-retarding polymer (commercial reference: Lifoflex 50 from Hexpol)—constituting 20% by weight of the sheath (melting temperature: 125° C. to 160° C., block Tg: −40° C. to 0° C.); and polymer used for obtaining a miscible mixture: ethylene, maleic anhydride, and acrylic acid ester terpolymer (commercial reference: Lotader 8200 from Arkema—constituting 20% by weight of the sheath (melting temperature: 100° C. to 115° C., Tg: 40° C. to 60° C.)

The fabrication method used is shown diagrammatically in FIG. 2, as for Example 1.

Operating Conditions:

preheating of the yarn: 80° C.;

extrusion temperatures:

| Feed zone | Body of the extrusion device | Die |
|---|---|---|
| 145° C. | 145° C. to 175° C. | 195° C. |

material pressure: 5 bars;

cooling temperature: 12° C.;

winding tension: 150 g/yarn;

winding speed: 400 m/min;

mean diameter of the yarn finally obtained: 350 μm.

The textile surfaces made using this yarn by knitting or weaving (18/18 basket weave) gave rise to products of M1 classification in the standard NFP 92507 and B1 classification in the standard DIN 4102/1.

The invention claimed is:

1. A method of fabricating a yarn constituted by a multi-filament core coated in a polymer sheath, said sheath comprising two coaxial polymer zones in succession, referred to as an inner zone and an outer zone, the outer zone incorporating at least one flame-retarding agent, the concentration of the flame-retarding agent in the outer zone being greater than the concentration of the flame-retarding agent in the inner zone, the method comprising:

making the sheath by depositing a miscible mixture of molten polymers on the multi-filament core, the mixture comprising:

said at least one flame-retarding agent; and at least two polymers that, in the molten state, do not establish mutual permanent chemical bonds, with one of the polymers, referred to as the co-flame-retarding polymer, presenting both a glass transition temperature that is lower than the glass transition temperature of the other polymer, referred to as the base polymer, and also a melting temperature that is likewise lower than the melting temperature of the base polymer;

said deposition being followed by a cooling step, during which, the base polymer freezes first and the co-flame-retarding polymer migrates outwards entraining at least a fraction of the flame-retarding agent therewith.

2. The method according to claim 1, wherein the fabricated yarn is halogen-free.

3. The method according to claim 1, wherein the yarn is cooled with a plateau at a temperature lower than the glass transition temperature of the base polymer, but higher than the glass transition temperature of the co-flame-retarding polymer.

4. The method according to claim 1, wherein the deposition is performed with a step of calibration by extruding a sheath on the yarn core and calibrating the sheath by passing through a die.

5. The method according to claim 1, wherein:

the base polymer(s) is/are selected from the group consisting of acrylic or methacrylic acid esters; non-halogenated vinyl polymers; polyurethanes; polyamides; thermoplastic polyolefins; thermoplastic olefin elastomers; styrene copolymers of the styrene butadiene or styrene ethylene butylene styrene type; polyesters; and silicones; and the co-flame-retarding polymer(s) is/are selected from the group consisting of copolyamides; copolyesters; polyurethanes; polyolefins; oleamides; erucamides; and styrene-based copolymers.

6. The method according to claim 1, wherein that the co-flame-retarding polymer presents:

firstly, a glass transition temperature that is at least 10° C. less than the glass transition temperature of the base polymer; and secondly, a melting temperature that is likewise at least 10° C. less than the melting temperature of the base polymer.

7. The method according to claim 1, wherein that the difference between the melting temperature of the co-flame-retarding polymer and the melting temperature of the base polymer lies in the range 15° C. to 50° C.

8. The method according to claim 1, wherein, in the fabricated yarn, the sheath constitutes 40% to 80% by weight of the total weight of the yarn.

9. The method according to claim 1, wherein, in the fabricated yarn, the outer zone contains a quantity of flame-retarding agent that corresponds to 15 wt % to 50 wt %, relative to the total weight of the sheath.

10. The method according to claim 1, wherein the fabricated yarn presents a mean diameter lying in the range 150±10% μm to 500±10% μm.

11. The method according to claim 1, wherein the fabricated yarn is circular in section and presents a constant diameter over the entire length of the yarn to within plus or minus 10%.

12. The method according to claim 1, wherein, in the fabricated yarn, at least 60%, of the total weight of the flame-retarding agent present in the sheath lies in the outer zone.

13. The method according to claim 1, wherein, in the fabricated yarn, the flame-retarding agent is distributed regularly in a polymer matrix forming the outer zone.

14. The method according to claim 1, wherein, in the fabricated yarn, the inner zone of the sheath is made of one or more base polymers selected from the group consisting of acrylic or methacrylic acid esters; non-halogenated vinyl polymers; polyurethanes; polyamides; thermoplastic polyolefins; thermoplastic olefin elastomers; styrene copolymers of the styrene butadiene or styrene ethylene butylene styrene type; polyesters; and silicones; and the polymer matrix of the outer zone of the sheath is formed by at least one base polymer identical to that present in the inner zone and by at least one co-flame-retarding polymer selected from the group consisting of copolyamides; copolyesters; polyurethanes; polyolefins; oleamides; erucamides; and styrene-based copolymers.

15. The method according to claim 1, wherein the multi-filament core is made of at least one thermoplastic polymer.

16. The method according to any claim 1, wherein the flame-retarding agent is a phosphorous-containing or a nitrogen-containing flame-retarding agent.

17. The method according to claim 1, wherein the difference between the melting temperature of the co-flame-retarding polymer and the melting temperature of the base polymer lies in the range 30° C. to 50° C.

18. The method according to claim 1, wherein, in the fabricated yarn, the sheath constitutes 50% to 70% by weight of the total weight of the yarn.

19. The method according to claim 1, wherein, in the fabricated yarn, the outer zone contains a quantity of flame-retarding agent that corresponds to 20 wt % to 30 wt %, relative to the total weight of the sheath.

20. The method according to claim 1, wherein the fabricated yarn presents a mean diameter lying in the range 200±10% μm to 400±10% μm.

21. The method according to claim 1, wherein, in the fabricated yarn, at least 75%, of the total weight of the flame-retarding agent present in the sheath lies in the outer zone.

22. The method according to claim 1, wherein the multi-filament core is made of at least one thermoplastic polymer, selected from the group consisting of polyamides, polyesters, polyurethanes, polyolefins, vinyl polymers, and cellulose acetate, and a mixture of such polymers.

23. The method according to claim 1, wherein the flame-retarding agent is selected from the group consisting of ammonium polyphosphates, melamine isocyanurate, derivatives of pentaerythritol and of melamine, and ammonium molybdates.

* * * * *